US008430687B2

(12) United States Patent
Zraik

(10) Patent No.: US 8,430,687 B2
(45) Date of Patent: Apr. 30, 2013

(54) METHOD AND APPARATUS FOR A SNAP RETAINED PUSH-ON CONNECTOR WITH PORT ADAPTER

(75) Inventor: Souheil Zraik, Liverpool, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 3 days.

(21) Appl. No.: 13/078,877

(22) Filed: Apr. 1, 2011

(65) Prior Publication Data

US 2012/0252264 A1 Oct. 4, 2012

(51) Int. Cl.
*H01R 9/05* (2006.01)

(52) U.S. Cl.
USPC ..... 439/578

(58) Field of Classification Search ..... 439/578, 439/587, 595, 584, 607, 322
See application file for complete search history.

(56) References Cited

U.S. PATENT DOCUMENTS

| | | | | |
|---|---|---|---|---|
| 7,946,885 | B2 * | 5/2011 | Amidon et al. | 439/578 |
| 8,075,338 | B1 * | 12/2011 | Montena | 439/578 |
| 2010/0022125 | A1 * | 1/2010 | Burris et al. | 439/584 |

* cited by examiner

*Primary Examiner* — Tulsidas C Patel
*Assistant Examiner* — Phuongchi Nguyen
(74) *Attorney, Agent, or Firm* — Schmeiser, Olsen & Watts LLP

(57) ABSTRACT

A connector assembly includes a connector body and a tubular post having one end fitted in said connector body for securing a coaxial cable, the post including a basket portion at an opposite end. An adapter is further provided, the adapter having a set of internal threads for engaging the threads of an external interface port, said adapter further including a portion which is sized to engage within the interior of the basket portion of the tubular post.

14 Claims, 4 Drawing Sheets

METHOD AND APPARATUS FOR A SNAP RETAINED PUSH-ON CONNECTOR WITH PORT ADAPTER

FIELD OF THE INVENTION

This disclosure relates generally to the field of coaxial cable connectors and, more specifically, to a push-on connector that is adaptively configured for engagement with a remote appliance or interface port.

BACKGROUND OF THE INVENTION

CATV systems have significant problems that are associated with loose connections within subscriber's homes. Most frequently, these connections are loose because the threaded connections between an appliance such as a television, DVD player, computer or conversion box and a coaxial cable carrying the signal is difficult to tighten and most subscribers will not make the effort to secure the connectors so long as the picture quality is adequate, while not realizing that other services including data and VOIP (Voice over Internet Protocol) may also be adversely affected.

So-called push-on connectors are commonly known in the field. To some extent, these forms of connectors improve some of the above noted difficulties but because these connectors are not really adapted to engage a threaded (standard) port, many provide weak or unstable electrical and mechanical contact, wherein few of the above forms of push-on connectors presently available in the field actually and positively latch the appliance or external interface port.

SUMMARY OF THE INVENTION

According to one aspect, there is provided a push-on connector assembly that includes a connector body and a tubular post having one end fitted in said connector body for securing a coaxial cable, the post including a basket portion at an opposite end. An adapter is further provided, the adapter having a set of internal threads for engaging the threads of an external interface port, said adapter further including a portion which is sized to engage within the interior of the basket portion of the tubular post.

The herein described push-on connector/port combination latches in a manner that does not require actuation other than the application of sufficient axial force to engage or disengage the connector with the port. Because the latching mechanism requires the connector and the port to have complementary engagement surfaces, a port adapter may be needed. The adapter is initially threaded onto the port and must be properly tightened. However, the adapter only requires tightening the first time the connector is actually used, as the adapter can remain with the appliance port thereafter.

According to another version, there is provided in combination a coaxial cable connector and an interface port, said interface port having a threaded distal end, said connector comprising a connector body having a first end and a second end and an inner post having a first end and a second end, said second end being disposed within said connector body and said first end having a basket portion. The combination further includes an adapter, said adapter including a threaded first end which engages the threaded distal end of said interface port and a second end configured to engage the basket portion of said connector.

According to another version, there is provided a method for connecting a prepared coaxial cable to a threaded interface port. The method includes the steps of providing a connector assembly, a port adapter, and a receptacle within an interior region of the port adapter. The connector assembly includes a connector body and a post disposed within the connector body. The post has a first end including a basket portion. The connector assembly has an opposing second end for securing the prepared coaxial cable. The port adapter includes threads at a first end for mating with the threads of the interface port, and an opposing second end including a push-on connector portion adapted engage the basket portion of the post. The method further includes the steps of threading the port adapter onto the interface port and applying axial force against the connector body to slideably engage the basket portion of the post with the second end of the port adapter.

Alternatively, parts with the proper engagement surfaces may be provided, for example, as original equipment on a CATV source and/or monitor/receiver devices.

An advantage realized by the present invention is improved versatility and adaptability.

Another advantage provided by the herein described connector is ease of use, improved connectivity and increased reliability, as compared with prior art connector devices.

BRIEF DESCRIPTION OF THE DRAWINGS

The features described herein can be better understood with reference to the drawings described below. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

The following description relates to a push-on connector assembly that enables use with various threaded appliance or remote interface ports.

Throughout the following course of discussion, several terms such as "above", "below", "distal", "proximal", "first", "second" and the like are used in an effort to provide a suitable frame of reference with regard to the accompanying drawings. These terms are not intended, however, to be overly limiting of the present invention as claimed, except where so specifically indicated herein. Moreover, the present embodiment relates to a specific type of coaxial cable connector but it will be readily apparent to those of ordinary skill that the concepts which are described herein can suitably be applied to literally any cable connector that can be used in conjunction with a remote appliance port.

Figure 1:
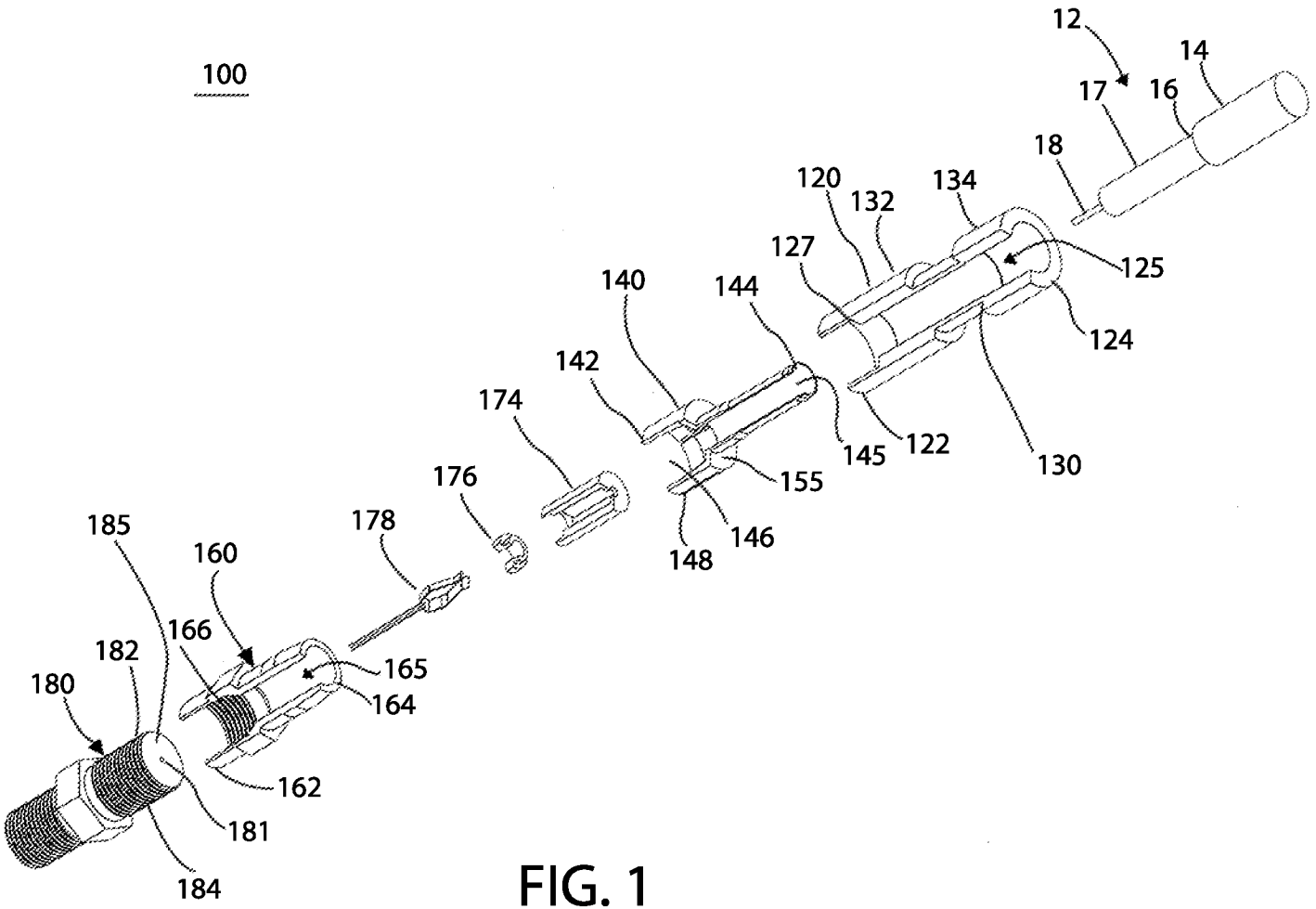
FIG. 1 is an exploded perspective view of a coaxial cable connector assembly which is made in accordance with an exemplary embodiment of the present application.

Turning first to FIG. 1, there is depicted a coaxial cable connector or connector assembly 100 as used in conjunction with a threaded appliance or interface port 180. The herein described connector assembly 100 is defined by an assemblage of components, which includes a connector body 120, an inner post 140 and a port adapter 160.

The connector body 120 according to this specific embodiment is a substantially cylindrical plastic-molded structure that includes respective first and second ends 122, 124 as well as a center passageway 125 that extends therethrough. The inner diameter of the connector body 120, as defined by the center passageway 125, is substantially uniform throughout its length with the exception of a recessed portion provided at the first end 122. The connector body 120 is further defined by a pair of sleeve portions 132, 134 that are separated by a frangible or weakened annular web portion 130. According to this particular design and upon the application of a sufficient axial force applied against one of the sleeve portions 134, the annular web portion 130 being a weakened area is caused to fracture wherein the sleeve portion 134 is then caused to pass over an axial section of the remaining sleeve portion 132. Though not shown, a portion of the interior diameter of the sleeve portion 134 is smaller than the outer diameter of the sleeve portion 132. As a result, the sleeve portion 134 creates radial compressive force against the other sleeve portion 132 so as to permit the securement of a prepared coaxial cable 12, which is disposed within the second end 124 of the connector body 120. Alternatively, a separate compression sleeve or member (not shown) can be provided in lieu of the one piece connector body 120, such as those found in F-type connectors, for example.

The inner post 140 of the herein described connector assembly 100 is defined by a substantially hollow tubular member having a first end 142 and an opposing second end 144. The second end 144 is configured to be fitted within the confines of the connector body 120 and includes a barbed end to assist in reliably securing the prepared coaxial cable end 12. The first end 142 of the inner post 140 includes an open-ended cylindrical sleeve or basket portion 146 that includes a plurality of axial slots 148, each of the slots being equally spaced circumferentially from one another according to this embodiment. Each of the axial slots 148 extend from the first end 142 to an intermediate position along the basket portion 146 and combine to form a set of spring fingers.

As shown in greater detail in FIG. 2, the open-ended basket portion 146 is defined by a cylindrical cavity defined at one end by a radial face 150, providing a retaining section for the port adapter 160, as described in greater detail below. The basket portion 146 according to this embodiment is further defined by an inner contour 149. The inner contour 149 extends for a short axial distance along a first inner diameter at the first end 142 of the inner post 140, followed by an inwardly tapering section that extends to a second smaller inner diameter adjacent an annular flange 155, defining a bottom or proximal surface of the defined basket portion 146. The inner post 140 is fitted within the confines of the connector body 120 such that the basket portion 146 is retained within the recessed portion 127 (FIG. 1) of the connector body 120 adjacent the first end 122 thereof and the remainder of the post extends into the center passageway 145. When assembled, a distal axial section of the basket portion 146 protrudes from the first end 122 of the connector body 120. According to this embodiment, the post 140 and at least minimally, the basket portion 146 thereof is made from an electrically conductive material, such as steel or brass.

Figure 2:
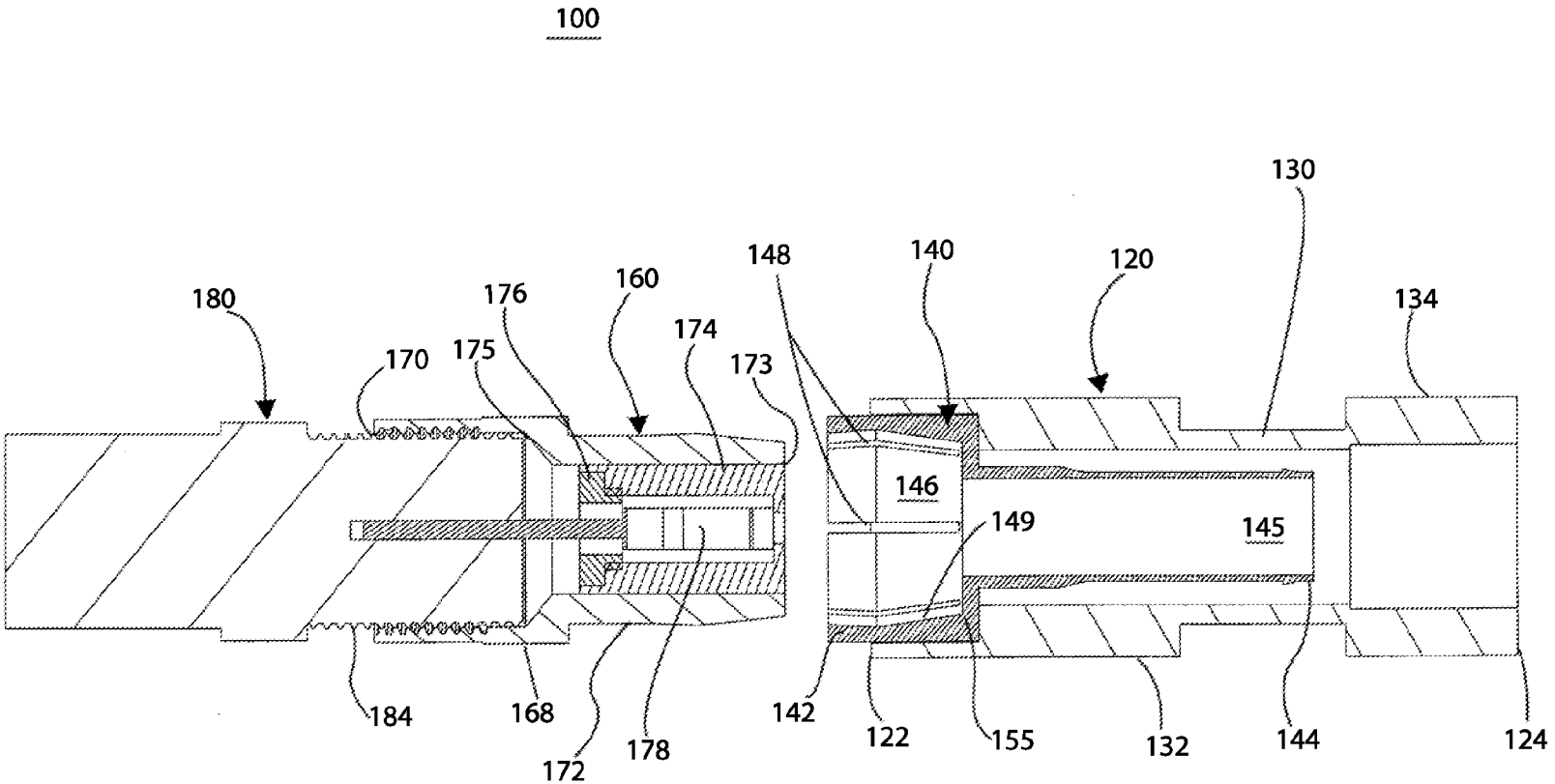
FIG. 2 is a partially assembled side elevational view of the coaxial cable connector assembly depicted according to FIG. 1.

Referring to FIGS. 1 and 2, the port adapter 160 is a hollow member which is fabricated from an electrically conductive material and defined by a first end 162 and an opposite second end 164. The first end 162 includes an interior axial threaded portion 166 wherein the threads have a height and pitch that mate to that of the exterior threads 184 of the interface port 180 to enable securement therewith. According to the present embodiment, the port adapter 160 can be made from brass, but any suitable electrically conductive material can be used. In one example, the port adapter can comprise a thin metal inner layer overmolded with plastic. A central bore or passageway 165 extends between the first and second ends 162, 164 of the adapter 160, the passageway having a first bore section 170 at the first end 162 at the interior threaded portion 166 and a second bore section 173 having a smaller interior diameter than that of the first bore section 170 adjacent the second end 164. As noted, the first bore section 170 includes the interior axial threaded portion 166.

An conical transitional portion 175 is disposed between the first and second bore sections 170, 173 having an interior diameter that conically tapers between the larger first and smaller second diameter. The herein described port adapter 160 further contains means for electrically engaging the center conductor 18 of the prepared coaxial cable end 12, FIG. 1. These means can include a receptacle 178 that is fitted within the second bore section 173 of the port adapter 160, the receptacle including a retaining member 176 fitted within the cored portion of a cylindrical insulator 174, the latter of which is sized to be fitted within the second bore section 173 of the adapter 160.

The exterior of the port adapter 160 further includes a nut portion 168 and a push-on connector portion 172. The nut portion 168 is disposed at an intermediate axial position between the first and second ends 162, 164, the nut portion extending over the transitional portion 175 and a portion of the first bore section 170. The push-on connector portion 172 is defined by a cylindrical exterior surface having a constant outer diameter which is smaller than that of the nut portion. The constant diameter extends from the nut portion 168 and tapers inwardly adjacent the second end 164 as a frustroconical section, the push-on connector portion corresponding substantially to that of the second bore section 173 of the adapter 160. According to the present embodiment, the taper of the push-on connector portion 172 is approximately five (5) degrees, but this parameter can be suitably varied.

Figure 3:
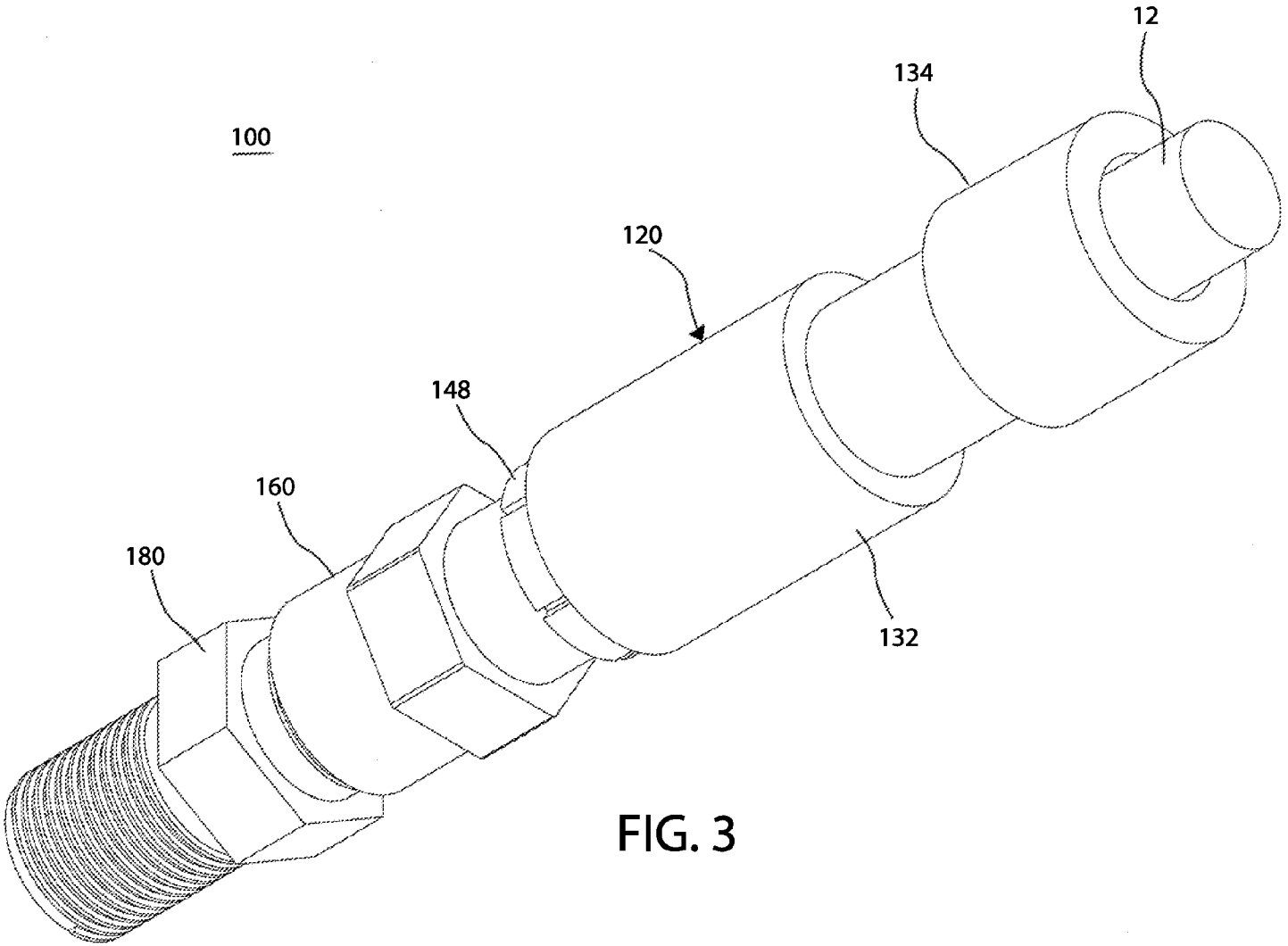
FIG. 3 is a side elevational view of the assembled coaxial cable connector assembly of FIGS. 1 and 2.
Figure 4:
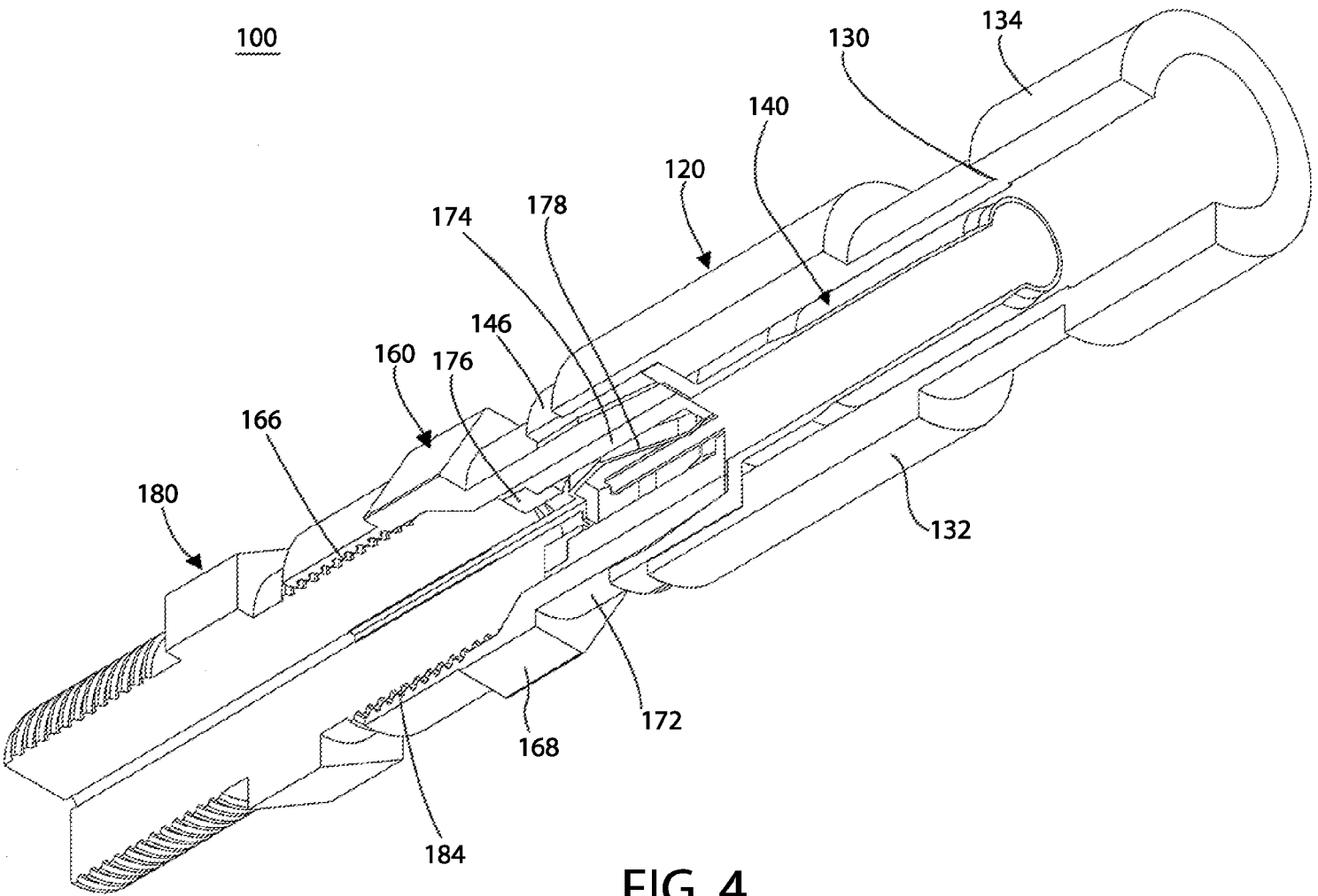
FIG. 4 is the side elevational view of the assembled coaxial cable connector assembly of FIG. 3, shown in section.

In operation, the port adapter 160 is initially fitted within the appliance interface port 180, as shown in FIGS. 2-4, such that the exterior threads 184 of the interface port are fully engaged with the interior threads of the port adapter 160, using the nut portion 168 to facilitate securing/fastening between the two components. The limit of travel of the port adapter is dictated by the length of the internal threaded surface wherein a radial end face 185 of the distal end of the interface port 180 contacts the transitional portion 175 of the inner diameter of the port adapter, as shown in FIG. 2. In this position, the proximal end of the receptacle 178 is fitted within the center opening 181 of the interface port 180, ensuring electrical as well as mechanical connectivity therewith.

The connector 100 has previously had the coaxial cable 12 secured thereto, wherein the prepared coaxial cable includes an outer sleeve or layer, a outer conductor 16, which can include a braided layer, an intermediate dielectric layer 17 and a center conductor 18 at the center of the cable. The cable 12, FIG. 1, is prepared wherein portions of the outer sleeve 14 and outer conductor 16 are each stripped away, leaving behind an axial portion of the dielectric layer 17 and center conductor 18. The dielectric layer 17 is further stripped away or cored to provide an additional axial section of the center conductor 18, as shown in FIG. 1. The cable end 12, as prepared, is then engaged with the second end 124 of the connector body 120 in combination with a compression tool (not shown). As previously noted, the application of an axial force against the second end 124 of the connector body 120 causes the frangible web portion 130, being a weakened area, to fracture and further causes the sleeve portion 134 to slide over a portion of the sleeve portion 132. As noted above, this movement causes the sleeve portion 134 to radially deform inwardly as the sleeve portion 134 axially slides over the sleeve portion 132 due to a mismatch between the inner diameter of the sleeve portion 134 and the outer diameter of the sleeve portion 132 in combination with the elastic deformable characteristics of the sleeve member 132. In the meantime, the dielectric layer 17 and center conductor 18 are retained within the confines of the inner post 130 while the outer conductor 16 and sleeve 14 are additionally stripped by the barbed end 134 of the post 140. The stripped portions 16, 14 are also engaged by the inwardly directed compressive forces generated by the moving sleeve portion 134, thereby securably retaining the prepared cable end 12 in place.

As shown in FIGS. 2-4, the connector 100 can then be engaged with the port/port adapter combination through axial engagement without having to threadingly engage the components together. That is, the push-in connector portion 172 is formed with complementary engagement surfaces with those of the basket portion 146 of the inner post 140 wherein the spring fingers of the basket portion are caused to deform outwardly in a radial fashion when the push-in connector portion is fully engaged. In the meantime, the center conductor 18 of the prepared cable end 12 is caused to engage with the distal end of the receptacle 178 of the port adapter 160, as shown in FIG. 4. The remainder of the coaxial cable 12, FIG. 1, is not shown in FIG. 4 for purposes of clarity. As such, electrical and mechanical connectivity are provided between the cable 12 and the interface port 180.

Removal of the connector 100 is accomplished by reversing the above steps. That is, the push-on connector portion 172 is axially withdrawn from the confines of the basket portion 148 of the connector 100. The port adapter 160 can remain attached to the interface port 180, thereby allowing connection to the connector 100 or another connector without modification. As a result of the above connector assembly, there is much less opportunity or significant risk in the loss of a threaded connectivity based on the provision of the port adapter 160.

Alternatively and in lieu of using a separate component adapter, the interface port itself could be reconfigured in order to include complementary engagement surfaces which are similar to those of the port adapter as previously described herein. As such, direct push-on or plug-in connectivity without requiring threading engagement or loss thereof can be easily and reliably provided.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been described, it will be understood that features and aspects that have been described with reference to each particular embodiment can be used with each remaining particularly described embodiment.

What is claimed is:

1. A coaxial cable connector assembly, said assembly comprising:

a connector body;

a post having a first end and a second end, said second end being disposed within said connector body for securing a coaxial cable end and said first end including a basket portion; and an adapter having a set of internal threads for engaging the threads of an external interface port, said adapter further including a portion which is sized to engage the basket portion of said post;

wherein the adapter is axially removable from the post when in an assembled state.

2. A connector assembly as recited in claim 1, wherein said connector body includes an integral compression sleeve.

3. A connector assembly as recited in claim 1, wherein said basket portion includes a radial wall having a set of axial slots.

4. A connector assembly as recited in claim 1, wherein said basket portion and the second end of said adapter each include tapering exterior surfaces.

5. A connector assembly as recited in claim 1, wherein said adapter includes a first end including said set of internal threads and a second end configured for engaging said basket portion of said post.

6. A connector assembly as recited in claim 5, wherein said adapter has complementary engagement surfaces with those of the basket portion of said post.

7. In combination, a coaxial cable connector and an interface port, said connector comprising:

a connector body having a first end and a second end; an inner post having a first end and a second end, said second end of said inner post being disposed within said connector body and said first end having a basket portion; and in which said interface port includes means for nonthreadingly and releasably engaging said basket portion.

8. A combination as recited in claim 7, wherein said means includes an adapter threading engaged with a threaded surface of said interface port at a first end and surfaces complementary to inner surfaces of said basket portion at a second end.

9. A combination as recited in claim 7, wherein said basket portion includes a radial wall with a plurality of spaced axial slots.

10. A combination as recited in claim 7, wherein said basket portion includes an interior inwardly tapering surface.

11. A method for connecting a prepared coaxial cable to a threaded interface port, comprising the steps of:

providing a connector assembly comprising a connector body and a post disposed within the connector body, the post having a first end including a basket portion, the connector assembly having an opposing second end for securing the prepared coaxial cable;

providing a port adapter comprising threads at a first end for mating with the threads of the interface port, and an opposing second end comprising a push-on connector portion adapted engage the basket portion of the post;

providing a receptacle within an interior region of the port adapter for electrically engaging at one end a center conductor of the prepared coaxial cable and at an opposing end a center opening of the interface port;

threading the port adapter onto the interface port; and applying axial force against the connector body to slideably engage the basket portion of the post with the second end of the port adapter.

12. The method of claim 11, wherein the connector body includes a frangible web portion, and the step of applying force against the connector body includes fracturing the web portion to create radial compressive forces against the prepared coaxial cable.

13. The method of claim 11, further comprising the step of providing a compression sleeve to create radial compressive forces against the prepared coaxial cable.

14. The method of claim 11, wherein the step of threading the port adapter onto the interface port includes limiting the travel of the port adapter by providing a transitional portion on the inner diameter of the port adapter and contacting the transitional portion with an end face of the interface port.

* * * * *